US006210029B1

(12) United States Patent
Noll et al.

(10) Patent No.: US 6,210,029 B1
(45) Date of Patent: Apr. 3, 2001

(54) REFLECTOR LAMP

(75) Inventors: Thomas Noll, Kipfenberg; Roland Stark, Wellheim, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/379,437

(22) Filed: Aug. 23, 1999

(30) Foreign Application Priority Data

Sep. 18, 1998 (DE) ..... 198 42 794

(51) Int. Cl.[7] ..... F21V 7/04
(52) U.S. Cl. ..... 362/549; 313/113; 313/318.01
(58) Field of Search ..... 362/226, 519, 362/548, 549, 509, 546, 310, 438; 313/113, 567, 578, 318.01, 318.07, 318.09

(56) References Cited

U.S. PATENT DOCUMENTS

| | | | | |
|---|---|---|---|---|
| 3,848,120 | * | 11/1974 | Wlolfe | 362/549 |
| 4,479,072 | * | 10/1984 | Gaugel | 313/113 |
| 4,829,210 | * | 5/1989 | Benson | 313/25 |
| 5,466,981 | | 11/1995 | Fields | 313/113 |
| 5,818,154 | * | 10/1998 | Helbig | 313/318.01 |

FOREIGN PATENT DOCUMENTS

| | | | |
|---|---|---|---|
| 1194088 | * | 9/1985 | (CA) . |
| 0 780884 | | 6/1997 | (EP) . |

* cited by examiner

*Primary Examiner*—Sandra O'Shea
*Assistant Examiner*—Hargobind S. Sawhney
(74) *Attorney, Agent, or Firm*—William E. Meyer

(57) ABSTRACT

The reflector lamp has a lamp support (10) which permanently connects the bulb (3) to the reflector neck (7). To this end, the lamp support has a clamping device (23) which cooperates with a web (11) on the reflector neck.

19 Claims, 4 Drawing Sheets

REFLECTOR LAMP

TECHNICAL FIELD

The invention proceeds from a reflector lamp in accordance with the preamble of claim 1. It relates, in particular, to reflector lamps, in particular for line voltage, fitted with a luminous element and with a halogen-containing filling.

BACKGROUND ART

Already known from document EP-A 780 884 is a reflector lamp with two-pin base, in the case of which a resilient lamp support fitted on the bulb is fitted transverse to the reflector axis and rests on an annularly circumferential step in the reflector neck. The lamp support is fastened in the reflector under biasing. U.S. Pat. No. 5,466,981 discloses a reflector lamp with a screw base and with a resilient lamp support. Fitted in the reflector neck are a plurality of circumferential steps, with the result that the same spherical cap can be used for bulbs and lamp supports of different size.

SUMMARY OF THE INVENTION

It is the object of the present invention to provide a reflector lamp in accordance with the preamble of claim 1 which permits the lamp support to be fastened reliably and in a clear-cut fashion in the reflector neck.

This object is achieved by means of the characterizing features of claim 1. Particularly advantageous refinements are to be found in the dependent claims.

The present invention relates to reflector lamps with bulbs pinched at one or two ends. A conventional screw base, or else a two-pin base can be used, for example, as the base. The lamp can be designed either for operating at low voltage (below 60 V) or at medium and high voltage, respectively, (approximately 120 V and 240 V respectively).

The bulb is permanently connected to a lamp support whose preferred shape is a disk. The disk can be slightly bent. Located in the reflector neck is a step on which the lamp support disk rests, possibly under biasing. The orientated, clear-cut fastening of the lamp support disk in the reflector is performed by up to four orientation means on the lamp support which cooperate with webs on the reflector neck. In the case of a plurality of orientation means (two to four), these are preferably distributed symmetrically about the reflector neck. For example, the orientation means is a semicircular cutout (or two mutually opposite cutouts) on the edge of the lamp support, which cutout is matched to the cross section of a web.

The orientation means is preferably constructed as a clamping device which is connected in a clamping fashion to the web, in particular by wedging the clamping device on the web in the reflector neck. It is preferred to use two mutually opposite spring tongues as clamping device.

In particular, the webs are axially parallel strips in the reflector neck which are assigned to the spring tongues or cutouts of the lamp support disk.

The assembly runs as follows in principle: for two-pin bases preparations are firstly made at the reflector. In the reflector bottom, two cylindrical contact parts or sleeves, which are at least partially hollow inside and whose function is the mechanical and/or electrical connection to the outer supply leads of the bulb, are riveted into corresponding openings.

This work operation can be eliminated when the reflector lamp has a screw base. In this case, the openings in the reflector bottom frequently taper conically, as a result of which threading in the supply leads is facilitated.

The lamp support disk is advantageously punched from a metal strip (for example spring steel). In principle, it is circular and has in the center an I-shaped cutout for holding the pinch of the bulb. Two pairs of inwardly pointing lugs are provided in the cutout for fixing the lamp in the disk. They are bent obliquely downward and latch tight in holding knobs on the pinch when the bulb is inserted into the disk from above. The lugs and assigned knobs can be arranged either on the narrow sides or broad sides of the I-shaped cutout or pinch. Inserting the lamp into the lamp support disk is expediently performed before the latter is separated from the carrier strip. In this process, the pinch is inserted into the provided opening with an I-shaped profile until the lugs of the lamp support disk latch tight over the, in particular four, holding knobs fitted on the broad side of the pinch, preserving a small biasing in the process. The lamp is therefore permanently connected to the disk. The lugs effect a permanent contact with the pinch. Together with the biased supporting surface of the disk on the bulb, this promotes dissipation of heat by the lamp.

According to the invention, at least one, preferably two or more clamping devices in the shape of radial spring tongues are provided on the periphery of the lamp support. They serve to fix the disk in the reflector. Two mutually opposite spring tongues are advantageously used. They are preferably bent slightly upward. They cooperate with webs, arranged in an axially parallel fashion, in the shape of strips in the reflector neck by bearing in a clamping fashion against them. In this case, the strip comes to be situated in the gap between the two spring tongues.

The assembly of the bulb and of the lamp support disk in the reflector is performed as follows: the subassembly of lamp and disk is held on the bulb and then inserted into the reflector from above until the lamp support disk touches the webs in the reflector neck. In this process, the lamp support disk and the spherical cap of the reflector are orientated relative to one another such that the gap between the two mutually opposite clamping springs comes to be situated exactly over the webs in the reflector neck.

Each web advantageously tapers conically upward, that is to say the cross section is reduced while the shape is maintained, with the result that a particularly reliable clamping action is achieved when the disk is pressed downward. The strips are advantageously made with a V-shaped or hemispherical cross section.

The lamp support disk is subsequently pushed downward as far as the step in the reflector neck with the aid of a tool (for example a hollow cylinder), acting on the outer edge of the disk. In this process, the two advantageously beveled ends of the clamping springs are bent further upward. The mechanical retention is performed in this case by "wedging" with the webs in the reflector neck.

In a second embodiment, the latching tight of the lamp support disk on an appropriately shaped web is implemented via a radial rotary movement in conjunction with a slight pressure on the bulb. The webs are then designed as bosses on which the spring tongues slide along radially in a clamping fashion.

Advantages of this fastening technique are:

The force with which the disk is pressed downward produces biasing mechanically in the disk, thus avoiding rattling of the lamp and ensuring the bulb is seated firmly in the reflector.

Given appropriate dimensioning, when the lamp support disk is pressed down, the outer supply leads (for example pins or wires) are guided through openings in the reflector bottom. Threading into the openings is not a problem. It proceeds largely automatically, since the disk is preadjusted by the webs.

Supply leads, guided through the contact parts, of a two-pin base are subsequently connected to the contact parts by crimping, welding or the like.

In the case of a screw base, the two outer supply leads (wires) initially project from the two openings in the reflector bottom. One wire is bent away laterally in a way known per se in order to provide the lateral contact. If desired, a fuse is welded onto the wire provided for the bottom contact. The screw base is subsequently pushed over. It is crimped with the reflector neck, the electric connection to the lateral contact being produced simultaneously. The electric connection with the bottom contact is expediently performed by welding or else soldering.

The design according to the invention yields the following advantages by comparison with existing techniques of assembly:

The design permits better optical screening of the reflector neck from the light emitted by the filament. Light is thereby prevented from emerging rearward. This effect has been particularly disturbing previously in the case of spherical caps mirrored with aluminum.

Moreover, the design permits better thermal screening of the pinch from the bulb. By contrast with conventional techniques of assembly, in which the lamp support disk is fastened only as a screen for the radiation at the bulb, here there is a contact surface of the disk with the reflector. The permanent connection promotes the dissipation of heat from the lamp via the disk to the reflector, in particular when the reflector is coated with aluminum. The point is that in this case the temperature loading is particularly high.

Moreover, according to the invention the temperature loading of the pinch and of the lamp support and, consequently, also of the contact parts and/or the base is reduced. Consequently, the invention permits the use of lamps with higher power without increasing the temperature loading of the pinch or base in the process. The production of so-called tarnishing colors on the lamp support disk is also reduced and, moreover, occurs with a time delay. Previously, these tarnishing colors were associated with light losses, in particular along the reflector axis.

The cementless design according to the invention permits the reflector to be assembled in a way which is easy to automate, simple, reliable and therefore cost-effective, and in which there is a high throughput of the machine. In particular, the time-consuming baking of a cement is now also eliminated.

According to the invention, the bulb of the lamp is permanently connected to the reflector by the lamp support by contrast with the prior art.

BEST MODE FOR CARRYING OUT THE INVENTION

Figure 1:
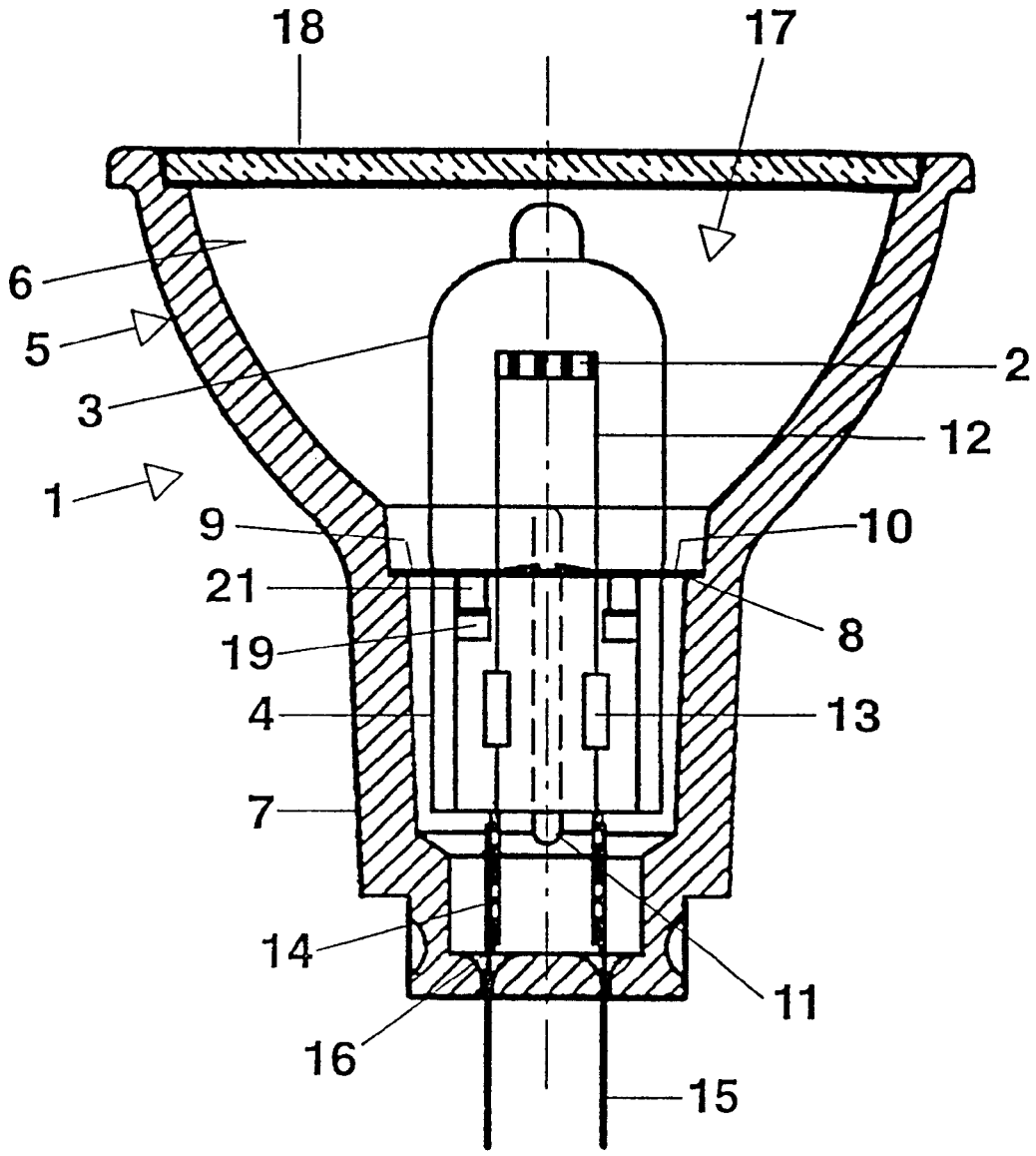
FIG. 1 shows a reflector lamp, in section.
Figure 2:
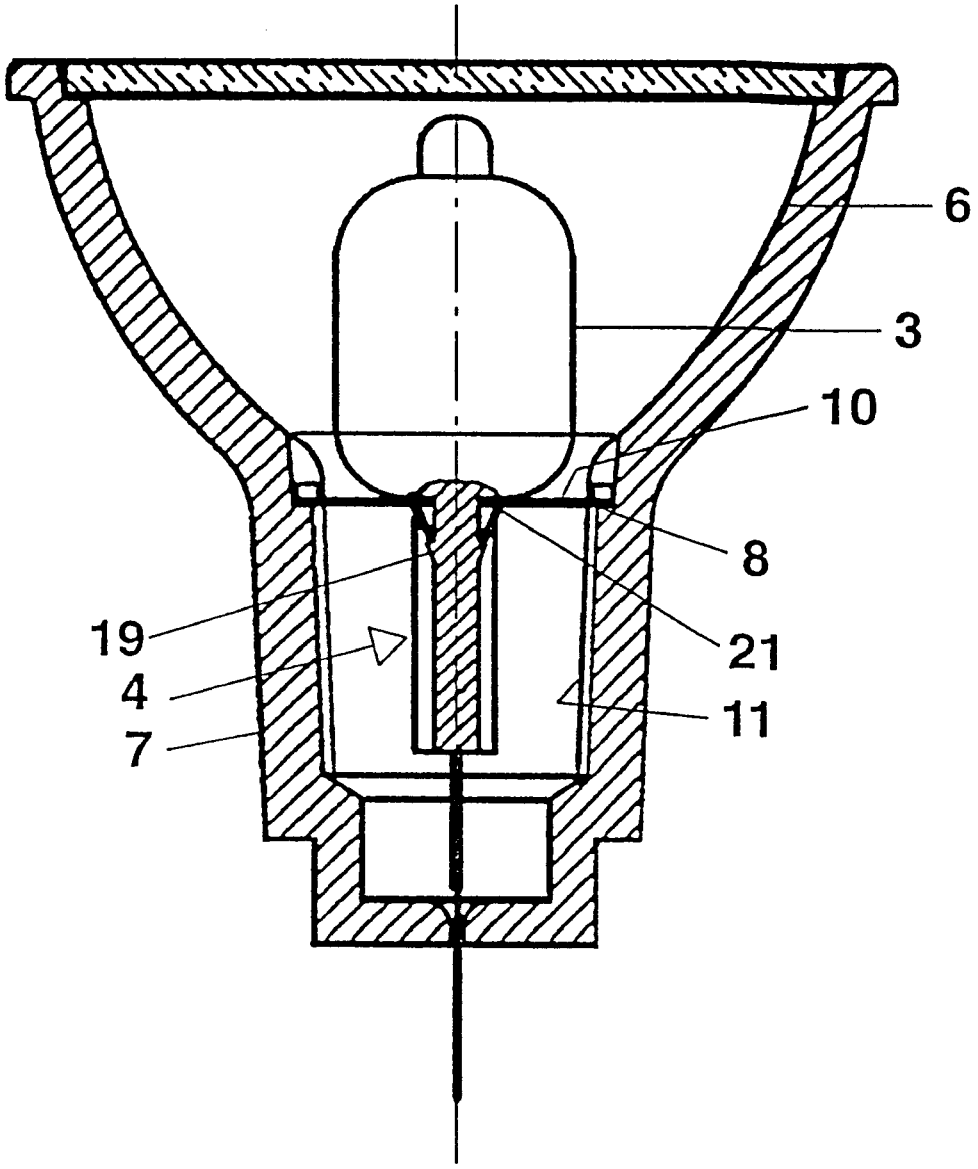
FIG. 2 shows the reflector lamp of FIG. 1, rotated by 90°.

FIGS. 1 and 2 show a reflector lamp 1 on the base of a halogen incandescent lamp pinched at one end and having a diagrammatically represented luminous element 2 in a bulb 3 made from silica glass (or hard glass) and a pinch seal 4. The bulb 3 is seated in a reflector 5 made from glass which is coated inside with aluminum and whose spherical cap comprises a faceted reflector contour 6 and a reflector neck 7 and has an axis X. In the region of the transition between contour 6 and neck 7, the reflector has an annularly circumferential offset which is constructed as a step 8. The circular edge 9 of a lamp support rests on the step 8. It is constructed as a centering disk 10 and fixed on two webs in the form of axially parallel strips 11 in the reflector neck.

The luminous element 2 is connected via in each case two inner supply leads 12, foils 13 and outer supply leads 14 to extension pins 15.

The pins 15 are led out of the reflector neck 7 through two conically tapering openings 16 in the bottom of the reflector. The openings can maintain contact parts for the two-pin base (not shown).

The centering disk 10 is biased at approximately 9 N, with the result that the lamp is locked particularly firmly in the reflector.

The reflector opening 17 is sealed with a cover plate 18.

Figure 3:
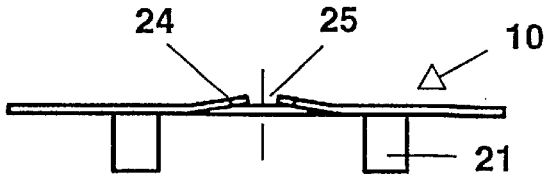
FIG. 3 shows a detailed view of the lamp support before assembly.
Figure 4:
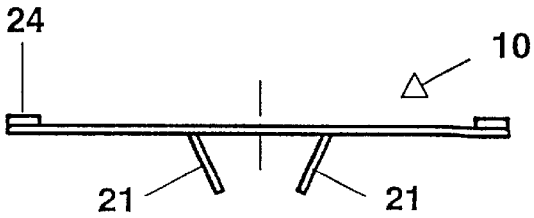
FIG. 4 shows a further view of the lamp support in accordance with FIG. 3, but rotated by 90°.
Figure 5:
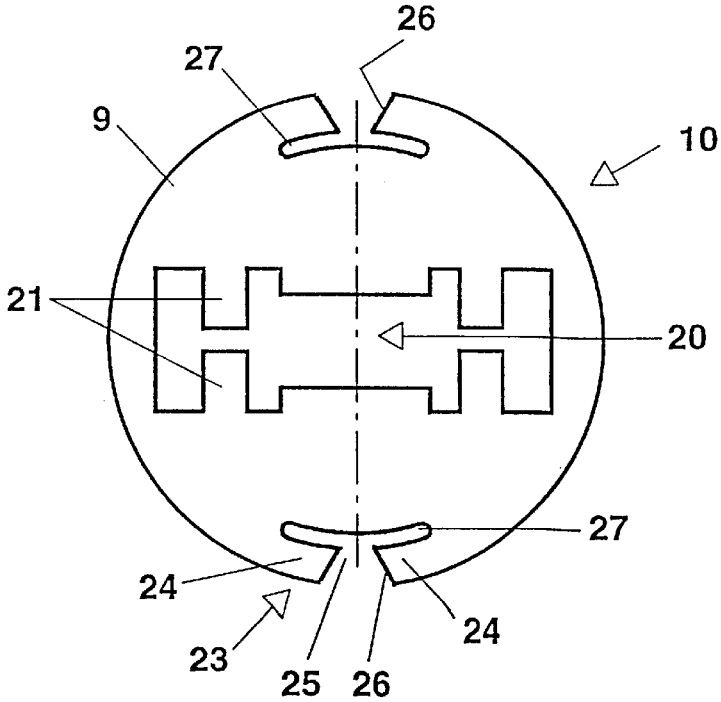
FIG. 5 shows a plan view of the lamp support before assembly.

In accordance with FIGS. 3 to 5, the disk 10 made from punched sheet of high-grade steel has a central I-shaped cutout 20 in which two pairs of rectangular lugs 21 are situated opposite one another. These lugs 21 are bent away downward and in accordance with FIGS. 1 and 2 latch tight on saw-tooth knobs 19 on the broad sides of the pinch 4. Moreover, the centering disk has on the edge 9 a pair of mutually opposite clamping devices 23. Each comprises two radially mutually opposite spring tongues 24 which leave a gap 25 between themselves. The gap-side edge 26 of each spring tongue is beveled. The spring tongues 24 are separated from the interior part of the centering disk 10 by a radially running gap 27. In accordance with FIG. 3, they are bent slightly upward.

Figure 6:
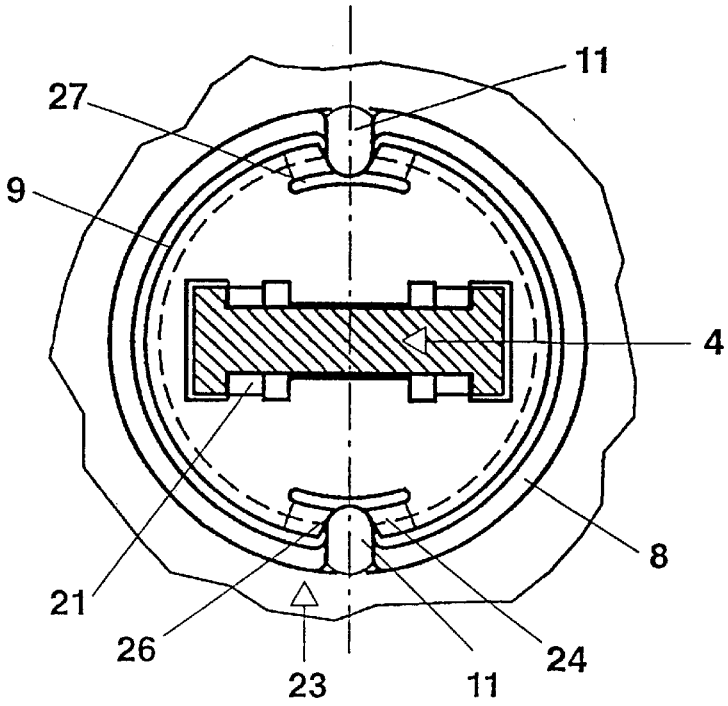
FIG. 6 shows a plan view of the lamp support after assembly.

In the installed state in accordance with FIG. 6, the two tongues 24 of a pair clamp the web 11 between themselves. The beveled edge 26 of the tongues is optimally matched to the web 11, since the cross section of the web is rounded off inward. The centering disk is thus aligned in the defined position.

In another exemplary embodiment, the lamp is a discharge lamp, for example a metal halide lamp pinched at one end, or a halogen incandescent lamp (tubular lamp) pinched at two ends.

In a further exemplary embodiment, the clamping device is a single radial spring tongue which is bent slightly upward and in this case bears in a clamping fashion against a web which is hemispherical or resembles a boss. Clamping tight is performed by a radial rotation.

It is not mandatory for the lamp support to have resilient properties, since permanent seating of the bulb in the reflector is already achieved solely by the clamping fastening of the lamp support in the reflector neck.

The circularly circumferential step can also be of simplified design. This simplifies production and saves material. In particular, it can comprise two subsections of a circle in the shape of half moons which are opposite one another.

Figure 7:
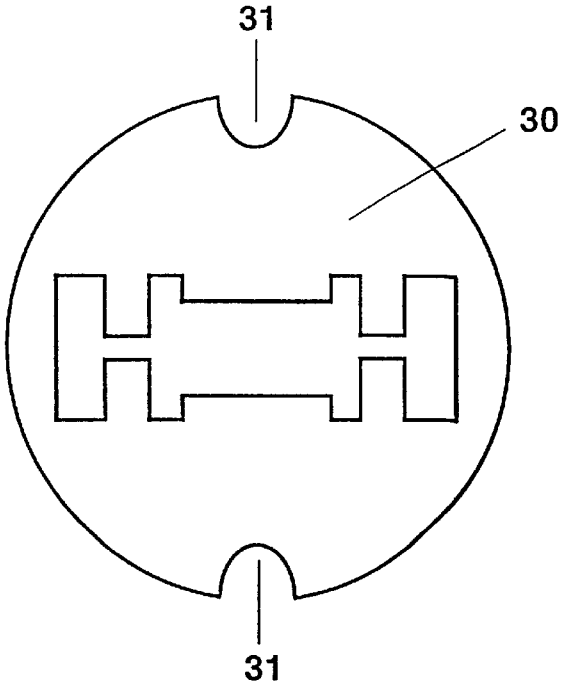
FIG. 7 shows a plan view of a further exemplary embodiment of a lamp support before assembly.

A further exemplary embodiment of a lamp support in the form of a centering disk 30 is shown in FIG. 7. This disk has as orientation means two semicircular, mutually opposite cutouts 31 on the periphery of the disk. The cutouts cooperate with two webs which are matched thereto and extend inward from the reflector neck, in a fashion similar to that shown in FIG. 6. The shape of the cutouts and webs matched thereto can, for example, also be a V or elliptical. Resilient biasing of the lamp support, similar to that described in the prior art, is to be recommended with this embodiment.

Apart from the steps 8, oblique steps situated below the pinch of the lamp are shown in FIGS. 1 and 2. The transition between neck and bottom advantageously contains instead of this or additionally an oblique step formed by the pressing tool during production of the glass spherical cap. It can reach up to the hole cutouts and/or extend a threading aid in the region of the hole cutouts. It can also be present between the two cutouts as a middle stage. The insertion bevel can have the shape of a conical or pyramidal frustum. The supply lead is guided by means of this circumferential insertion bevel during threading, and thus led more easily to the bottom cutout 16.

What is claimed is:

1. A reflector lamp (1) whose bulb (3) is sealed at least at a first end with the aid of a pinch (4), at least one supply lead (14) being guided outward from the pinch (4), and having a reflector (5) which has a reflecting contour (6) and a reflector neck (7) and defines a reflector axis, the pinch (4) being arranged in the reflector neck (7), and at least one supply lead (14) being guided on the bottom of the reflector neck, and a lamp support (10) connected to the bulb (3) being supported in the interior of the reflector, wherein the lamp support has a substantially planar periphery on which is mounted at least one clamping device which cooperates with an inwardly projecting web (11) in the region of the reflector neck (7) to clamp the lamp support to the web.

2. The reflector lamp as claimed in claim 1, wherein the lamp support is a resilient punched sheet-metal part whose spring force acts along the reflector axis.

3. The reflector lamp as claimed in claim 1, wherein the periphery of the disk and the clamp device are substantially co-planar.

4. The reflector lamp as claimed in claim 1, wherein the clamping device comprises at least one spring tongue.

5. The reflector lamp as claimed in claim 1, wherein the clamping device comprises a pair of mutually opposite spring tongues (24) which are spaced apart by a gap (25).

6. The reflector lamp as claimed in claim 4, wherein the gap-side edge (26) of the spring tongues is beveled.

7. The reflector lamp as claimed in claim 1, wherein the web is constructed as a strip (11) aligned in an axially parallel fashion.

8. The reflector lamp as claimed in claim 7, wherein the strip has a V-shaped or hemispherical cross section.

9. The reflector lamp as claimed in claim 7, wherein the cross section of the strip (11) increases toward the bottom of the reflector.

10. The reflector lamp as claimed in claim 1, wherein the orientation means is a cutout (31) on the edge of the lamp support (30).

11. The reflector lamp as claimed in claim 1, wherein the reflector neck further includes at least one interior locating surface defining a plane, and the periphery of the disk is abutted against the locating surface to be substantially co-planar therewith.

12. The reflector lamp as claimed in claim 11, wherein the periphery of the disk and the clamp device are substantially co-planar.

13. The reflector lamp as claimed in claim 11, wherein the clamping device comprises at least one spring tongue.

14. The reflector lamp as claimed in claim 11, wherein the clamping device comprises a pair of mutually opposite spring tongues (24) which are spaced apart by a gap (25).

15. The reflector lamp as claimed in claim 14, wherein the gap-side edge (26) of the spring tongues is beveled.

16. The reflector lamp as claimed in claim 11, wherein the web is constructed as a strip (11) aligned in an axially parallel fashion.

17. The reflector lamp as claimed in claim 16, wherein the strip (11) has a V-shaped or hemispherical cross section.

18. The reflector lamp as claimed in claim 16, wherein the cross section of the strip (11) increases toward the bottom of the reflector.

19. The reflector lamp as claimed in claim 11, wherein the orientation means is a cutout (31) on the edge of the lamp support (30).

* * * * *